US011239599B2

(12) United States Patent
Torrey et al.

(10) Patent No.: US 11,239,599 B2
(45) Date of Patent: Feb. 1, 2022

(54) MODULAR HOUSING ASSEMBLY WITH STABILIZING FEATURES

(71) Applicant: TE Connectivity Services GmbH, Schaffhausen (CH)

(72) Inventors: Eric J. Torrey, Bloomfied Hills, MI (US); Hurley Chester Moll, Hershey, PA (US); Matthew Bryan Hitchcock, Hershey, PA (US)

(73) Assignee: TE Connectivity Services GmbH

( * ) Notice: Subject to any disclaimer, the term of this patent is extended or adjusted under 35 U.S.C. 154(b) by 0 days.

(21) Appl. No.: 16/872,658

(22) Filed: May 12, 2020

(65) Prior Publication Data

US 2021/0359457 A1 Nov. 18, 2021

(51) Int. Cl.

| | |
|---|---|
| ***H01R 13/514*** | (2006.01) |
| ***H01R 13/506*** | (2006.01) |
| ***H01R 13/516*** | (2006.01) |
| ***H01R 13/518*** | (2006.01) |

(52) U.S. Cl.

CPC ..... *H01R 13/514* (2013.01); *H01R 13/506* (2013.01); *H01R 13/516* (2013.01); *H01R 13/518* (2013.01)

(58) Field of Classification Search

CPC .... H01R 13/46; H01R 13/506; H01R 13/514; H01R 13/516; H01R 13/518; H01R 12/724; H05K 5/0047

See application file for complete search history.

(56) References Cited

U.S. PATENT DOCUMENTS

| | | | | |
|---|---|---|---|---|
| 6,773,272 | B2 | 8/2004 | Koehler et al. | |
| 7,080,990 | B1 | 7/2006 | Juntwait et al. | |
| 8,904,633 | B2 * | 12/2014 | Blossfeld | H05K 5/003 29/884 |
| 9,277,658 | B2 | 3/2016 | Tanaka et al. | |
| 10,455,712 | B1 | 10/2019 | Malecke et al. | |
| 2015/0280376 | A1 * | 10/2015 | Xiao | H01R 12/724 439/660 |

OTHER PUBLICATIONS

International Search Report, International Application No. PCTIB2021/054048 International Filing Date, May 12, 2021

* cited by examiner

*Primary Examiner* — Oscar C Jimenez

(57) ABSTRACT

An assembly having an electrical connector and a modular housing. The cooperation of positioning projections of the modular housing with stabilizing sections of the electrical connector provides a stable and precise mating between the electrical connector and the modular housing in four directions which are perpendicular to the plane of insertion of the electrical connector into the modular housing. The cooperation of latches of the electrical connector with latch receiving recesses of the modular housing provides a stable and precise mating between the electrical connector and the modular housing in two directions which are in line with the plane of insertion.

18 Claims, 6 Drawing Sheets

MODULAR HOUSING ASSEMBLY WITH STABILIZING FEATURES

FIELD OF THE INVENTION

The present invention is directed to a modular housing and a modular housing assembly with stabilizing features which prevent movement of the an electrical connector in the modular housing, thereby eliminating the need for an over-molded module.

BACKGROUND OF THE INVENTION

When assembling an electrical connector to a mating electrical connector or panel, the positioning of the male blades of the terminals of the electrical connector must be controlled to ensure proper mating of the terminals of the electrical connector to mating terminals of the mating electrical connector or panel. Properly controlling the positioning of the male blades of the terminals minimizes the possibility of stubbing the terminals and the mating terminals as mating occurs. This is particularly important in connectors with numerous terminals.

As components of the electrical connector are mated together, the positioning and latching portions of the components cooperate with mating positioning and latching portions of other components, thereby allowing proper assembly of the components. Known positioning and latching portions are manufactured to facilitate some movement or play between the components, thereby facilitating easy assembly. While in many circumstances, the movement between the components is not harmful, in other circumstances, such as is situations where there are very tight tolerances, the movement of the components is not acceptable.

In order to more precisely control the location of the terminals and the components, the assembled electrical connector may be over-molded into an over-molded module. In so doing, the location of the terminals and components can be controlled. In addition, in environments in which vibration occurs, the over-molded module does not allow unwanted movement of the terminals or components during use.

It would be, therefore, be beneficial to provide a modular housing and a modular housing assembly with stabilizing features which prevent movement of the an electrical connector in the modular housing without the need for over-molding.

SUMMARY OF THE INVENTION

An embodiment is directed to a modular housing for receiving at least one electrical connector assembly therein. The modular housing has a front wall, an oppositely facing back wall and side walls that extend between the front wall and the back wall. A bottom wall extends between the front wall, the back wall and the side walls. A connector receiving opening is provided in the front wall. A connector receiving area is provided proximate the front wall, the connector receiving area is dimensioned to receive the electrical connector assembly therein. Positioning projections extend into the connector receiving area, the positioning projections extend from the bottom wall and are positioned proximate the front wall.

An embodiment is directed to an assembly having an electrical connector and a modular housing. The electrical connector has a housing with latches extending from connector sidewalls and a stabilizing section. The modular housing has a connector receiving area dimensioned to receive the electrical connector therein. Positioning projections extend into the connector receiving area. The positioning projections cooperate with the stabilizing section of the electrical connector. Latch receiving recesses are positioned on each side of the connector receiving area. The latch receiving recesses cooperate with the latches of the electrical connector. The cooperation of the positioning projections with the stabilizing sections provides a stable and precise mating between the electrical connector and the modular housing in four directions which are perpendicular to the plane of insertion of the electrical connector into the modular housing. The cooperation of the latches with the latch receiving recesses provides a stable and precise mating between the electrical connector and the modular housing in two directions which are in line with the plane of insertion Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
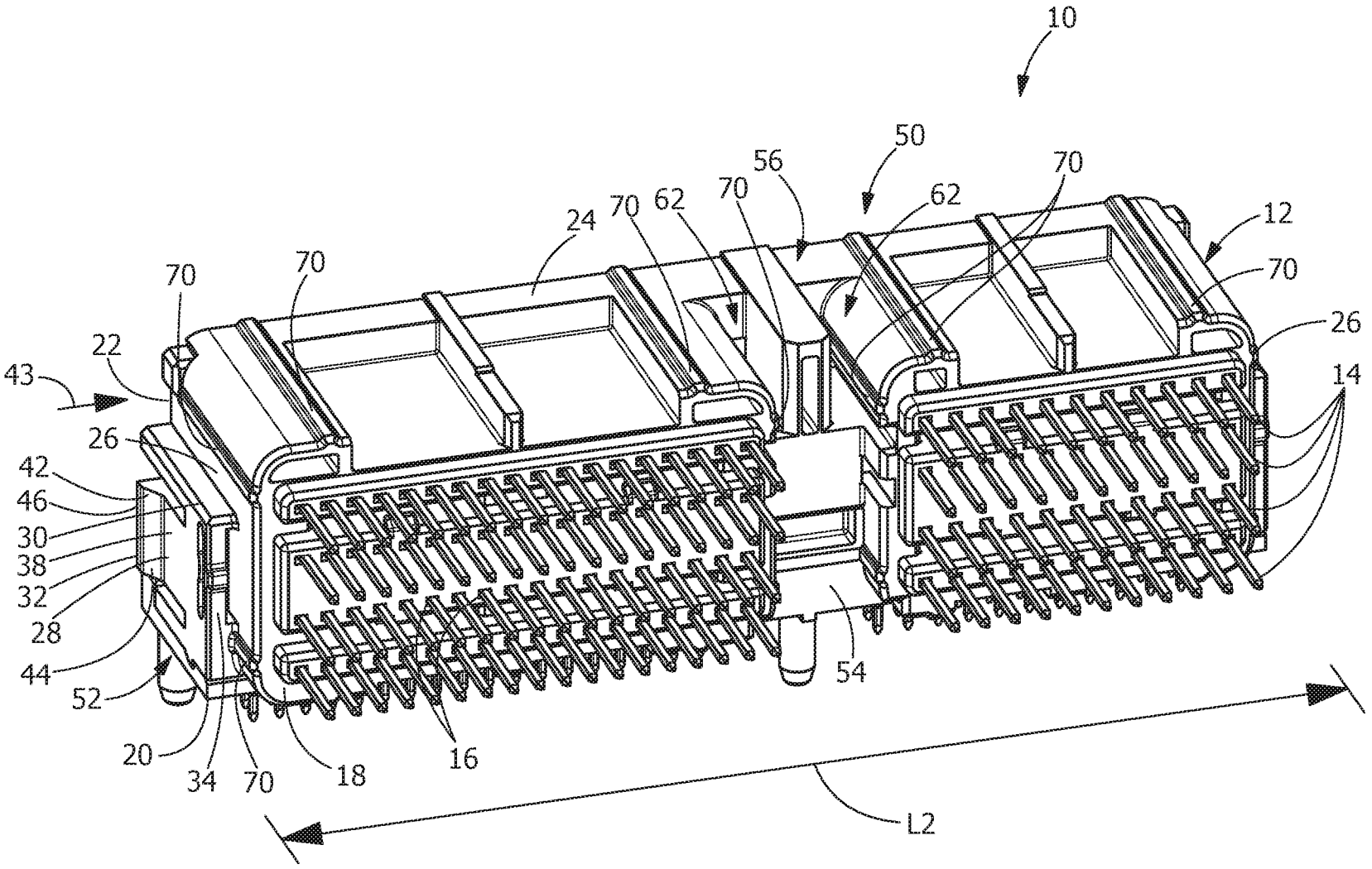
FIG. 1 is a perspective view of an illustrative assembled electrical connector.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

Moreover, the features and benefits of the invention are illustrated by reference to the preferred embodiments. Accordingly, the invention expressly should not be limited to such embodiments illustrating some possible non-limiting combination of features that may exist alone or in other combinations of features, the scope of the invention being defined by the claims appended hereto.

As shown in FIG. 1, an electrical connector assembly 10 has a housing 12 with terminals 14 positioned in terminal receiving cavities 16. The particular configuration and the number of the terminals 14 and terminal receiving cavities 16 may vary without departing from the scope of the invention. The housing 12 has a first wall or mating face 18, a circuit board receiving face 20, a second or back wall 22, a bottom wall 24 and side walls 26.

Figure 6:
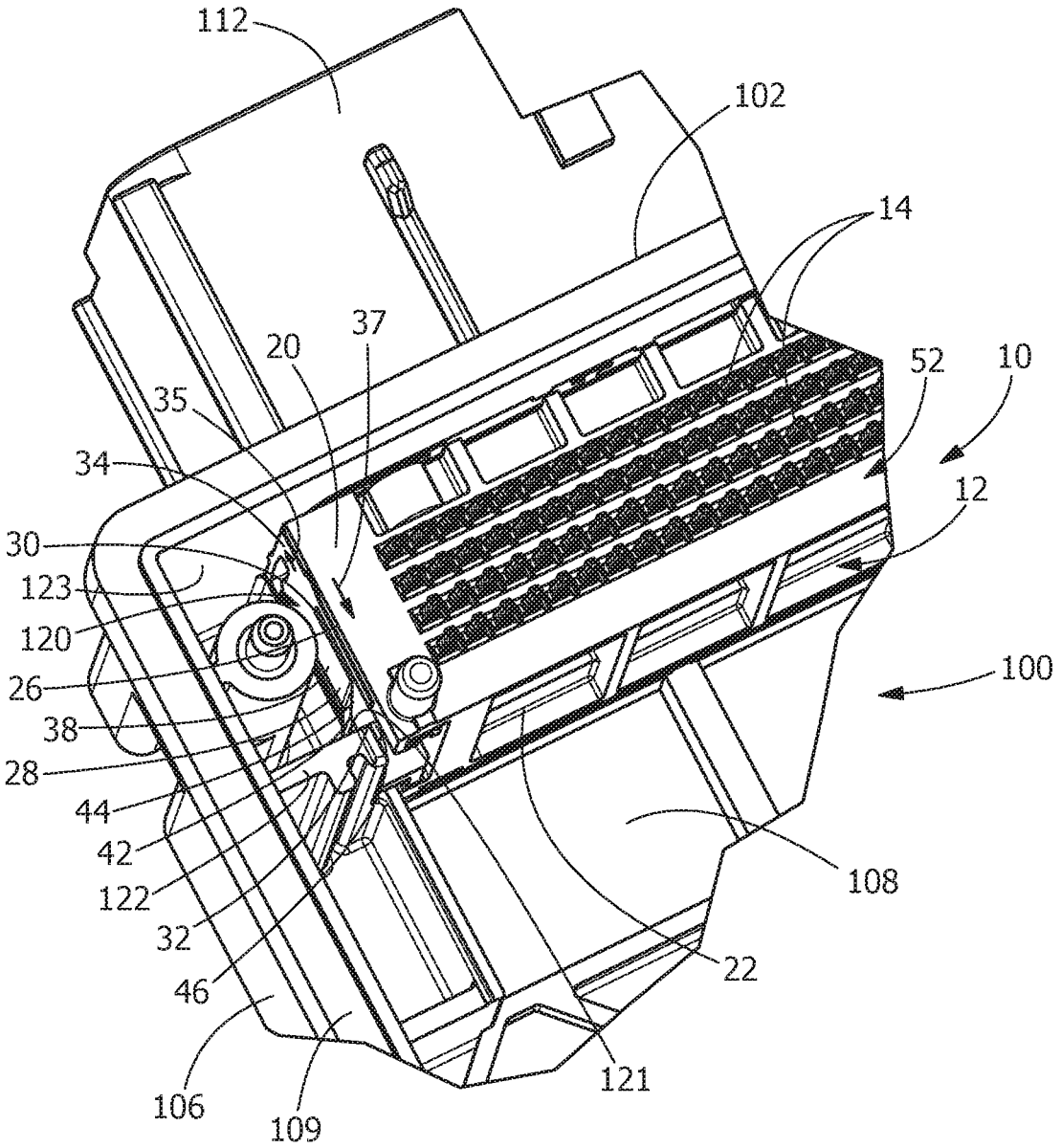
FIG. 6 is an enlarged view of a portion of FIG. 3 showing a latch positioned in a latch receiving recess.

In the illustrative embodiment shown in FIG. 1, a latch 28 extends from proximate the first wall 18 of the housing 12 to proximate the second wall 22. As shown in FIGS. 1 and 6, the latch 28 has attachment sections 30 which attach the latch 28 to the side wall 26 of the housing 12. The latch 28 has a latching region or end 32 and an oppositely facing biasing region or end 34.

The latching region or end 32 has a resilient latching arm 38 which has a free end with a latching projection 42 provided proximate thereto. The latching projection 42 has a lead-in surface 44 and a locking or reference surface 46. Although the locking or reference surface 46 is positioned on the latching projection 42, the locking or reference surface 46 may be provided at other locations on the latch 28. The latch projection 42 is resiliently deformable in a direction of arrow 43 shown in FIG. 1.

In the illustrative embodiment shown, the electrical connector assembly 10 has a pin plate holder 50 (FIG. 1) and a pin block holder 52 (FIG. 1) which are mated together to form the housing 12 of the electrical connector assembly 10. The pin plate holder 50 and the pin block holder 52 are described in co-pending U.S. patent application Ser. No. 16/872,732, entitled Electrical Connector Header With Stabilizing Features, filed on the same date of this application, which is incorporated by reference herein in its entirety. The electrical connector assembly 10 shown and described is one illustrative embodiment of the type of electrical connector assembly 10 that may be used.

Figure 5:
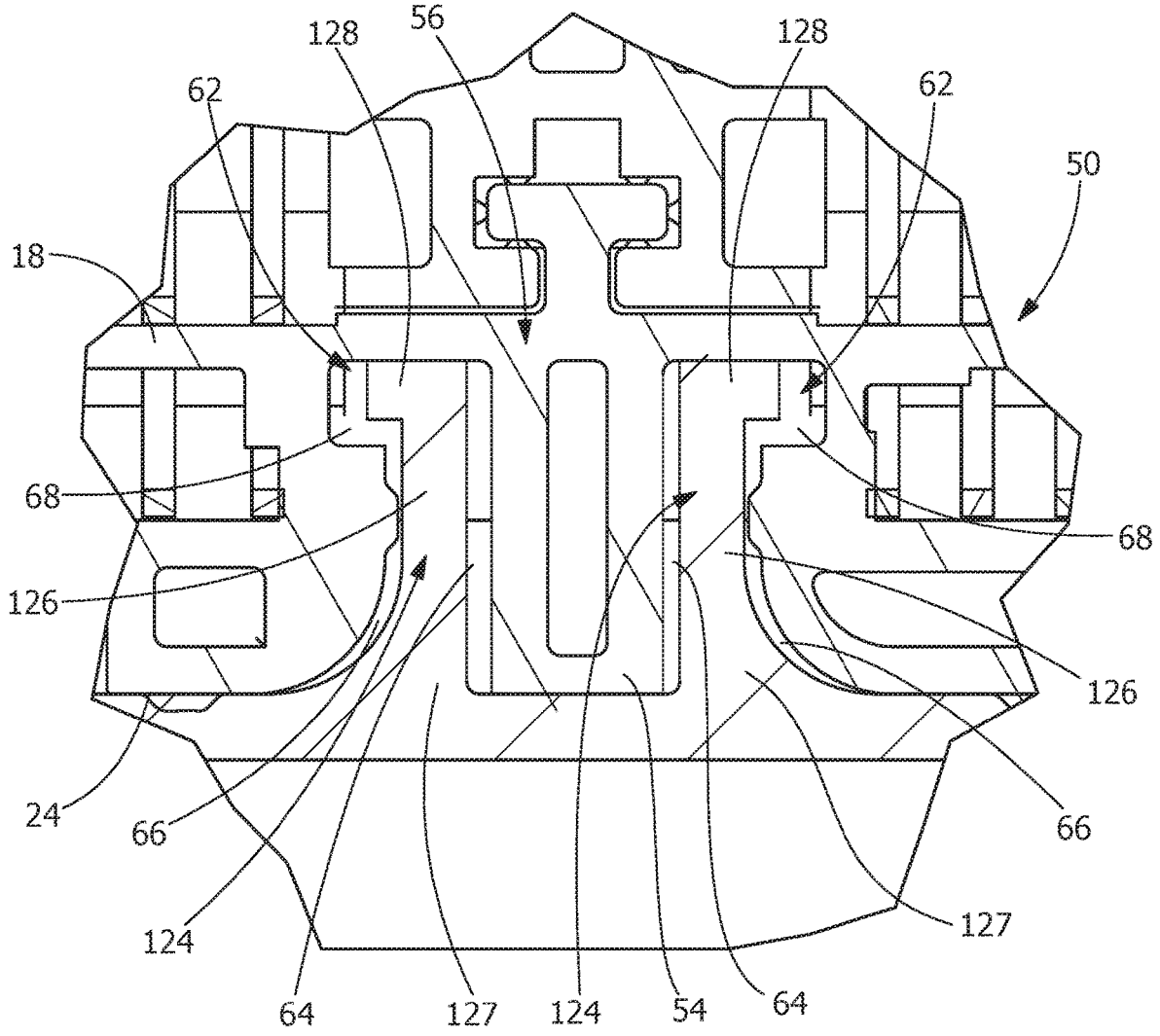
FIG. 5 is an enlarged cross-sectional view of a portion of FIG. 3 showing positioning projections of the modular housing positioned in projection receiving slots the electrical connector.

As shown in FIGS. 1 and 5, the illustrative pin plate holder 50 has a stabilizing section 54 positioned proximate the longitudinal center of the pin plate holder 50. However, the stabilizing section 54 may be located at other positions on the pin plate holder 50 which are aligned with the stabilizing section 30 of the pin block holder 12. In addition, more than one stabilizing section 54 may be provided at different locations on the pin plate holder 50.

The stabilizing section 54 has a rib receiving section 56 which extends from the bottom wall 24 of the connector assembly 10 in a direction toward the circuit board receiving face 20 of the connector assembly 10. The rib receiving section 56 has projection receiving slots 62 which open toward the mating face 18 of the connector assembly 10. As shown in FIG. 5, the projection receiving slots 62 have vertical sections 64 which extend from bottom wall 24 of the connector assembly 10. The projection receiving slots 62 may have enlarged base sections 66. Securing member receiving sections 68 extend from the vertical sections 64. The securing member receiving sections 68 extend at an angle from the vertical sections 64. In the illustrative embodiment shown, the securing member receiving sections 68 extend at approximately right angles to the vertical sections 64, such that the securing member receiving sections 68 extend essentially parallel to the bottom wall 24. However, other configurations of the vertical sections 64 and the securing member receiving sections 68 may be used.

As shown in FIG. 1, stabilizing ribs 70 are positioned proximate the bottom wall 24 and side walls 26. The spacing and positioning of the stabilizing ribs 70 may vary. The stabilizing ribs 70 extend outward from the bottom wall 24 and the side walls 26. Stabilizing ribs 70 are also positioned in the rib receiving section 56 of the stabilizing section 54. The stabilizing ribs 70 cooperate with the modular housing 100 to facilitate the stable and precise mating between the electrical connector assembly 10 and the modular housing 100.

Figure 2:
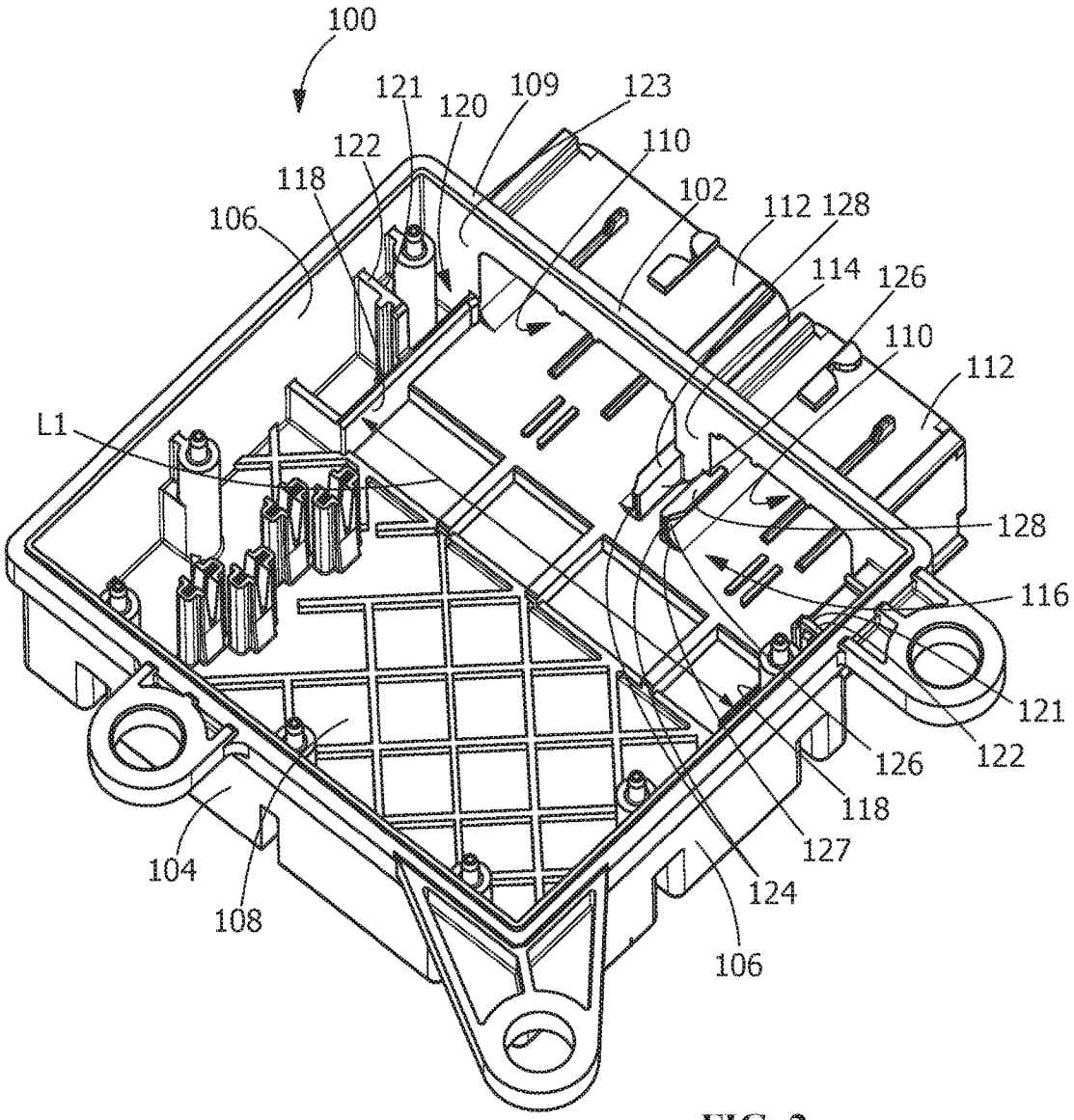
FIG. 2 is a top perspective view of an illustrative module housing of the present invention.
Figure 3:
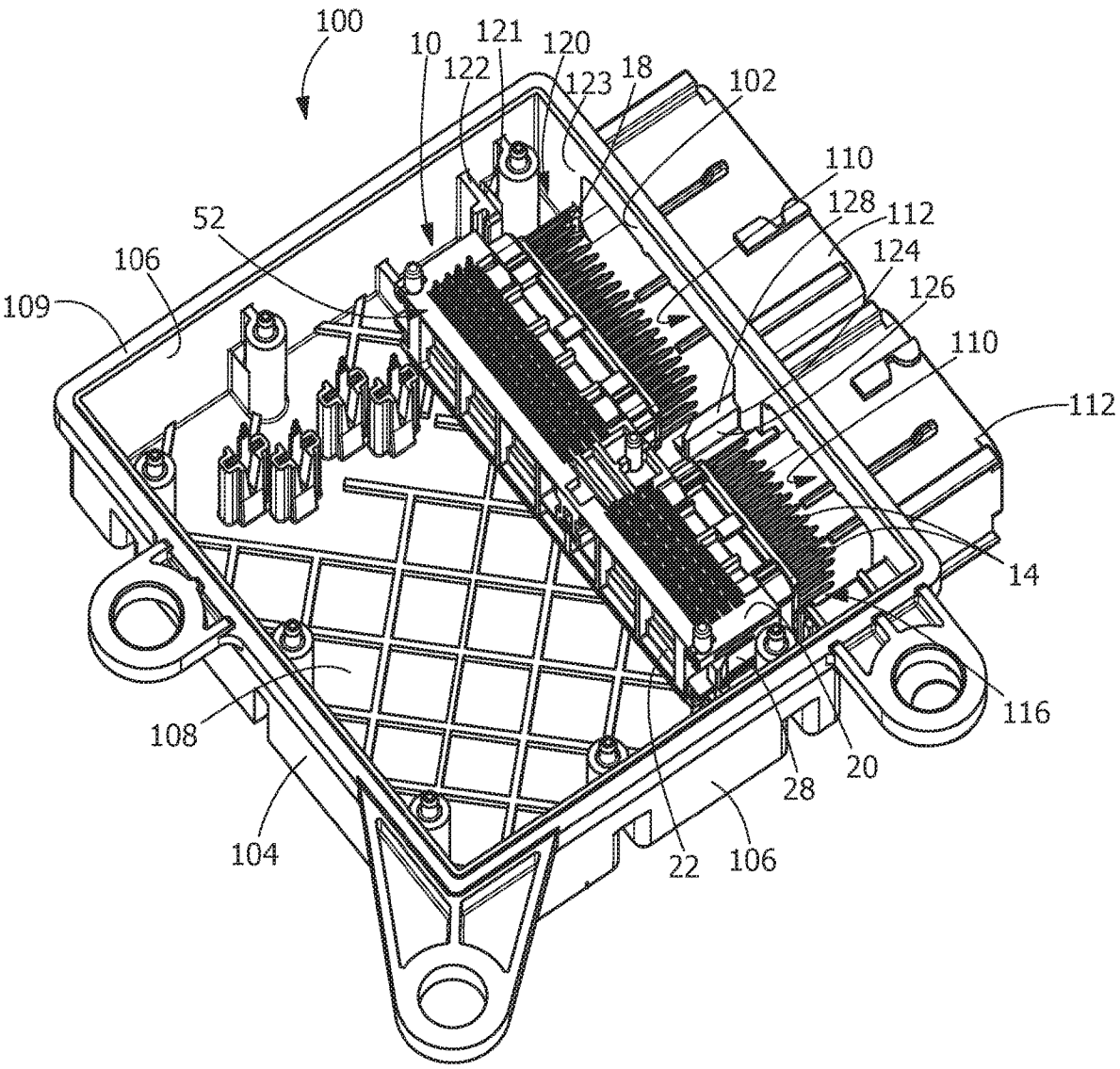
FIG. 3 is a top perspective view of the electrical connector partially inserted into the module housing.
Figure 4:
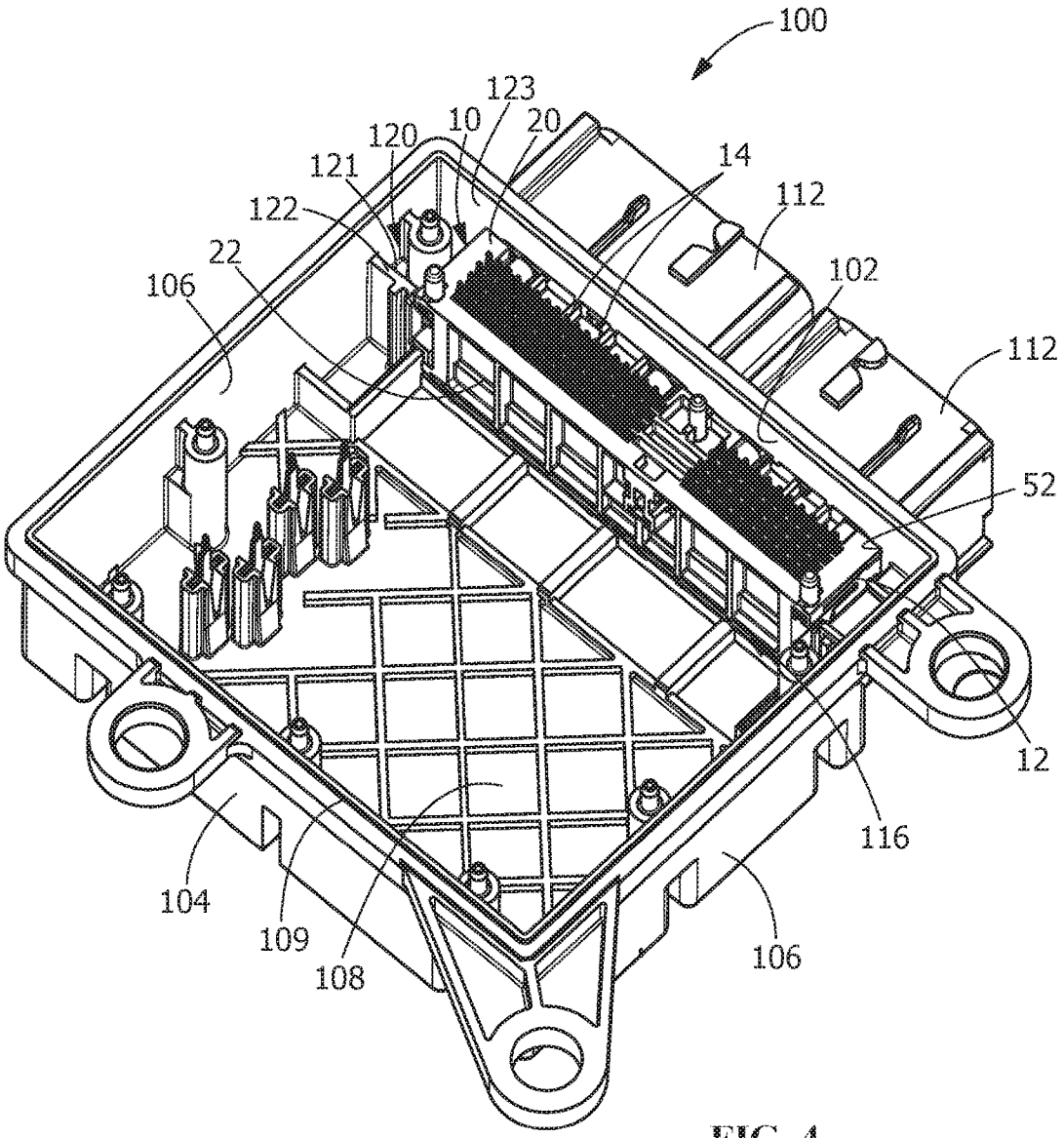
FIG. 4 is a top perspective view of the electrical connector fully inserted into a module housing.

As shown in FIG. 2, a modular housing 100 is provided for receiving the electrical connector assembly 10 therein. The modular housing 100 has a front wall 102, an oppositely facing back wall 104 and side walls 106 that extend between the front wall 102 and the back wall 104. A bottom wall 108 extends between the front wall 102, back wall 104 and side walls 106. A cover (not shown) may be provided on a top surface 109 of the modular housing 100.

As shown in FIG. 2, the front wall 102 has two connector receiving openings 110 provided therein. Mating connector receiving shrouds 112 extend from the front wall 102 in a direction away from the back wall 104. The mating connector receiving shrouds 112 extend about the circumference of the connector receiving openings 110. The connector receiving openings 110 are spaced from each other by rib 114 which is a portion of the front wall 102. While two connector receiving openings 110 and one rib 114 are shown, different numbers of connector receiving openings and ribs may be provided without departing from the scope of the invention.

A connector receiving area 116 is provided proximate the front wall 102. The connector receiving area 116 is dimensioned to receive the connector assembly 10 therein. Positioning walls 118 are positioned on each side of the connector receiving area 116. The positioning walls 118 extend from proximate the front wall 102 toward the back wall 104. The positioning walls 118 extend in a direction which is essentially perpendicular to the front wall 102. The positioning walls 118 extend from the bottom wall 108 toward the top surface 109. The height of the positioning walls 118 as measured from the bottom wall 108 is less than the height of the front wall 102. The positioning walls 118 are positioned on opposite sides of the connector receiving openings 110. The length or space L1 provided between the positioning walls 118 is approximately equal to the length L2 of the connector assembly 10.

Latch receiving recesses 120 are positioned on each side of the connector receiving area 116. The latch receiving recesses 120 extend from proximate the front wall 102 toward the back wall 104. The latch receiving recesses 120 extend from the positioning walls 118 toward the top surface 109. The latch receiving recesses 120 are positioned on opposite sides of the connector receiving openings 110.

The latch receiving recesses 120 have latching regions or walls 122 which are spaced from the front wall 102. The latching walls 122 have a mating locking or reference surface 121. The front wall 102 has a biasing surface 123. The mating locking or reference surface 121 is configured to face the biasing surface 123. The mating locking or reference surface 121 and the biasing surface 123 are two walls which define the latch receiving recess 120.

As shown in FIGS. 2 and 5, positioning projections 124 extend into the connector receiving area 116. The positioning projections 124 extend from the bottom wall 108 and are positioned proximate the front wall 102. The positioning projections 124 may be integrally formed with the bottom wall 108 and the front wall 102. The positioning projections 124 are provided proximate the rib 114 of the front wall 102. However, the positioning projections 124 may be provided in other locations proximate the front wall 102.

The positioning projections 124 have vertical members 126 which extend from the bottom wall 108. The positioning projections 124 may have enlarged base sections 127 to provide sufficient strength to the positioning ribs 124 to prevent the breakage of the positioning projections during use. Connector assembly securing members 128 extend from the free ends of the vertical members 126. The securing members 128 extend at an angle from the vertical members 126. In the illustrative embodiment shown, the securing members 128 extend at approximately right angles to the vertical members 126, such that the securing members 128 extend essentially parallel to the bottom wall 108. However, other configurations of the vertical members 126 and the securing members 128 may be used.

During assembly of the electrical connector 10 into the modular housing 100, the electrical connector 10 is initially moved into the modular housing 100 through the top surface 109 until the bottom wall 24 of the electrical connector 10 engages or is proximate to the bottom wall 104 of the modular housing 100. With the electrical connector 10 positioned in the modular housing 100, the connector assembly 10 is then moved toward the front wall 102 of the modular housing 100. As this occurs, the stabilizing ribs 70 of the side walls 26 of the connector assembly 10 engage the positioning walls 118 of the modular housing 100 to properly align the connector assembly 10 with the front wall 102 of the modular housing 100. The stabilizing ribs 70 also engage the bottom wall 108 of the modular housing 100 to properly position the connector assembly 10 with the connector receiving openings 110. With the continued insertion, the terminals 14 are inserted into the connector receiving openings 110 of the modular housing 100.

During insertion, the latches 28 are moved into the latch receiving recess 120. As this occurs, the latching arms 38 engage the latching walls 122. Continued insertion causes the lead-in surfaces 44 of the latching projections 42 of the latching arms 38 to engage the latching walls 122, causing the latching projections 42 and the latching arm 38 to resiliently deform toward the side walls 26 of the housing 12 of the connector 10. With continued insertion, the latching projections 42 are moved past the latching walls 122, to the position shown in FIG. 6, allowing the latching arms 38 to return to their unstressed position. In this position, the locking or reference surfaces 46 are positioned proximate to and are facing the mating locking or reference surface 121.

The insertion force exerted on the connector 10 and latches 28 is then removed. With the insertion force removed, the biasing ends 34 attempt to elastically return to the unstressed or unbent position and in turn, exert a force on the biasing surfaces 123. The latches 28, the biasing ends 34 and their operation are described in co-pending U.S. patent application Ser. No. 16/686,817, filed on Nov. 18, 2016, the entirety of which is incorporated herein by reference. As the biasing surfaces 123 are fixed, the movement of the biasing ends 34 back toward its unstressed position (as represented by arrow 35 in FIG. 6) causes the latches 28 and the connector 10 to be moved back toward the mating locking or reference surfaces 121 of the modular housing 100 (as represented by arrow 37 in FIG. 6). The movement, in the direction of arrow 37, continues until the locking or reference surfaces 46 abuts the mating locking or reference surfaces 121, thereby eliminating gaps between the locking or reference surfaces 46 and the mating locking or reference surfaces 121. With the locking or reference surfaces 46 in engagement with the mating locking or reference surfaces 121 and the biasing ends 34 in engagement with the biasing surfaces 123, the locking or reference surfaces 46 remain in engagement with the mating locking or reference surfaces 146, thereby ensuring that the latches 28 are accurately and precisely retained in position in the latch receiving recesses 120, and consequently, the connector 10 is accurately and precisely retained in the modular housing 100 in the plane which is parallel to the plane of the bottom surface 108.

In addition, as the connector assembly 10 is moved toward the front wall 102 of the modular housing 100, the projection receiving slots 68 of the connector assembly 10 engage the positioning projections 124 of the modular housing 100 to properly and accurately position the connector assembly 10 in the module housing 100. When fully inserted: the vertical members 126 of the positioning projections 124 are positioned in the vertical sections 64 of the projection receiving slots 62; the enlarged base sections 127 of the positioning projections 124 are positioned in the enlarged base sections 66 of the projection receiving slots 62; and the connector assembly securing members 128 of the positioning projections 124 are positioned in the securing member receiving sections 68 of the projection receiving slots 62.

As shown in FIG. 1, stabilizing ribs 70 are positioned about the bottom wall 24 and side walls 26. The spacing and positioning of the stabilizing ribs 70 may vary. The stabilizing ribs 70 extend outward from the bottom wall 24 and the side walls 26. Stabilizing ribs 70 are also positioned in the rib receiving section 56 of the stabilizing section 54. The stabilizing ribs 70 cooperate with the modular housing 100 to facilitate the stable and precise mating between the electrical connector assembly 10 and the modular housing 100.

The cooperation of: i) the stabilizing ribs 70 of the side walls 26 of the connector assembly 10 with the positioning walls 118 of the modular housing 100; ii) the stabilizing ribs 70 of the bottom wall 24 with bottom wall 108 of the modular housing 100; iii) the stabilizing ribs 70 of the rib receiving section 56 of the stabilizing section 54 with the positioning projections 124; and iv) the positioning projections 124 with the projection receiving slots 62 provides a stable and precise mating between the electrical connector assembly 10 and the modular housing 100 in four directions which are perpendicular to the plane of insertion, thereby minimizing movement of the electrical connector 10 and the terminals 14 relative to the modular housing 100 when assembled. In other words, the electrical connector 10 is precisely positioned in the modular housing 100 and prevented from unwanted movement in the direction toward either side wall 108, toward the bottom wall 108 or away from the bottom wall 108. This allows the electrical connector assembly 10 to be properly positioned relative to the modular housing 100 and a mating connector (not shown), thereby eliminating the need for over-molding of parts or components.

In addition, the cooperation and interaction of the latches 28 with the latch receiving recesses 120 provides a stable and precise mating between the electrical connector assembly 10 and the modular housing 100 in two directions which are in line with the plane of insertion, thereby minimizing movement of the electrical connector 10 and the terminals 14 relative to the modular housing 100 when assembled. In other words, the electrical connector 10 is precisely positioned in the modular housing 100 and prevented from unwanted movement in the direction toward the front wall 102 or toward the back wall 104.

Consequently, the electrical connector assembly 10 and the modular housing 100 are secured and precisely aligned in six directions (two directions previously described and four directions previously described), thereby minimizing movement of the electrical connector assembly 10 and the modular housing 100 relative to each other when assembled, thereby allowing for the precise positioning of the terminals 14 relative to the mating connector without the need for over-molding of the parts or components.

One skilled in the art will appreciate that the invention may be used with many modifications of structure, arrangement, proportions, sizes, materials and components and otherwise used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

We claim:

1. A modular housing for receiving at least one electrical connector assembly therein, the modular housing comprising:

a front wall, an oppositely facing back wall and side walls that extend between the front wall and the back wall, a bottom wall extends between the front wall, the back wall and the side walls;

a connector receiving opening provided in the front wall;

a connector receiving area provided proximate the front wall, the connector receiving area dimensioned to receive the electrical connector assembly therein;

positioning projections extending into the connector receiving area, the positioning projections extend from the bottom wall and are positioned proximate the front wall, securing members of the positioning projections extend essentially parallel to the bottom wall; wherein two connector receiving openings are provided in the front wall, the two connector receiving openings are spaced from each other by a rib which is a portion of the front wall; the positioning projections are provided proximate the rib of the front wall.

2. The modular housing as recited in claim 1, wherein mating connector receiving shrouds extend from the front wall is a direction away from the back wall, the mating connector receiving shrouds extend about the circumference of the connector receiving openings.

3. The modular housing as recited in claim 1, wherein positioning walls are positioned on each side of the connector receiving area, the positioning walls extend from proximate the front wall toward the back wall, the positioning walls extend in a direction which is essentially perpendicular to the front wall.

4. The modular housing as recited in claim 3, wherein the positioning walls extend from the bottom wall toward a top surface of the modular housing, the height of the positioning walls as measured from the bottom wall is less than the height of the front wall.

5. The modular housing as recited in claim 4, wherein the positioning walls are positioned on opposite sides of the connector receiving openings, the space provided between the positioning walls is approximately equal to the length of the electrical connector assembly.

6. The modular housing as recited in claim 5, wherein latch receiving recesses are positioned on each side of the connector receiving area, the latch receiving recesses extend from proximate the front wall toward the back wall, the latch receiving recesses extend from the positioning walls toward the top surface, the latch receiving recesses are positioned on opposite sides of the connector receiving openings.

7. The modular housing as recited in claim 6, wherein the latch receiving recesses have latching walls which are spaced from the front wall, the latching walls have a mating locking surface, the front wall has a biasing surface, the mating locking surface is configured to face the biasing surface, the mating locking surface and the biasing surface define the latch receiving recess.

8. The modular housing as recited in claim 1, wherein the positioning projections have vertical members which extend from the bottom wall, the securing members extend from free ends of the vertical members.

9. The modular housing as recited in claim 8, wherein the securing members extend at angles from the vertical members.

10. The modular housing as recited in claim 9, wherein the securing members extend at right angles from the vertical members.

11. The modular housing as recited in claim 8, wherein the positioning projections have enlarged base sections to provide strength to the positioning projections to prevent the breakage of the positioning projections during use.

12. An assembly comprising:

an electrical connector having a housing with latches extending from connector sidewalls and a stabilizing section;

a modular housing for receiving the electrical connector therein, the modular housing comprising:

a connector receiving area dimensioned to receive the electrical connector therein;

positioning projections extending into the connector receiving area, the positioning projections cooperating with the stabilizing section of the electrical connector;

positioning walls are positioned on each side of the connector receiving area of the modular housing;

latch receiving recesses positioned on each side of the connector receiving area, the latch receiving recesses cooperating with the latches of the electrical connector, the latch receiving recesses extend from the positioning walls toward a modular housing top surface;

wherein the cooperation of the positioning projections with the stabilizing sections provides a stable and precise mating between the electrical connector and the modular housing in four directions which are perpendicular to the plane of insertion of the electrical connector into the modular housing;

wherein the cooperation of the latches with the latch receiving recesses provides a stable and precise mating between the electrical connector and the modular housing in two directions which are in line with the plane of insertion.

13. The assembly as recited in claim 12, wherein the positioning walls extend from proximate a modular housing front wall toward a modular housing back wall, the positioning walls extend in a direction which is essentially perpendicular to the modular housing front wall.

14. The assembly as recited in claim 13, wherein the positioning walls extend from a modular housing bottom wall toward the modular housing top surface, the height of the positioning walls as measured from the modular housing bottom wall is less than the height of the modular housing front wall.

15. The assembly as recited in claim 14, wherein the latch receiving recesses extend from proximate the modular housing front wall toward the modular housing back wall.

16. The assembly as recited in claim 15, wherein the latch receiving recesses have latching walls which are spaced from the modular housing front wall, the latching walls have a mating locking surface, the modular housing front wall has a biasing surface, the mating locking surface is configured to face the biasing surface, the mating locking surface and the biasing surface define the latch receiving recess.

17. The assembly as recited in claim 16, wherein the positioning projections have vertical members which extend from the modular housing bottom wall, connector assembly securing members extend at an angle from free ends of the vertical members.

18. The assembly as recited in claim 16, wherein the securing members extend at angles from the vertical members.

* * * * *